US011486282B2

(12) United States Patent
Ming et al.

(10) Patent No.: US 11,486,282 B2
(45) Date of Patent: Nov. 1, 2022

(54) VACUUM CLEANER AND ELECTRIC MOTOR MODULE THEREOF

(71) Applicant: Midea Group Co., Ltd., Foshan (CN)

(72) Inventors: Lele Ming, Foshan (CN); Hui Zhang, Foshan (CN); Xiaowen Hu, Foshan (CN); Shuqi Li, Foshan (CN); Zhu Yang, Foshan (CN)

(73) Assignee: MIDEA GROUP CO., LTD., Foshan (CN)

( * ) Notice: Subject to any disclaimer, the term of this patent is extended or adjusted under 35 U.S.C. 154(b) by 530 days.

(21) Appl. No.: 16/735,565

(22) Filed: Jan. 6, 2020

(65) Prior Publication Data

US 2020/0141295 A1 May 7, 2020

Related U.S. Application Data

(63) Continuation of application No. PCT/CN2018/095569, filed on Jul. 13, 2018.

(30) Foreign Application Priority Data

Jul. 14, 2017 (CN) ..... 201710577287.8

(51) Int. Cl.

| | |
|---|---|
| ***F01N 1/04*** | (2006.01) |
| ***A47L 7/00*** | (2006.01) |
| ***F01N 1/02*** | (2006.01) |
| ***F01N 13/00*** | (2010.01) |
| ***A47L 9/28*** | (2006.01) |

(52) U.S. Cl.

CPC ..... *F01N 1/04* (2013.01); *A47L 7/0085* (2013.01); *F01N 1/023* (2013.01); *F01N 13/001* (2013.01); *F01N 13/002* (2013.01); *A47L 9/28* (2013.01)

(58) Field of Classification Search

CPC . F01N 1/04; F01N 1/023; F01N 3/001; F01N 13/002; A47L 7/0085; A47L 9/28

See application file for complete search history.

(56) References Cited

U.S. PATENT DOCUMENTS

2005/0194208 A1* 9/2005 Lalonde ..... F24F 13/24 181/269

FOREIGN PATENT DOCUMENTS

CN 1535643 A 10/2004
CN 1536235 A 10/2004
(Continued)

OTHER PUBLICATIONS

Midea Group Co. Ltd., First Office Action, CN201710577287.8, dated Nov. 21, 2019, 14 pgs.
(Continued)

*Primary Examiner* — Andrew A Horton
(74) *Attorney, Agent, or Firm* — Morgan, Lewis & Bockius LLP

(57) ABSTRACT

A vacuum clear and an electric motor module (100) therefor are provided. The electric motor module (100) includes an outer casing (1) provided with an air inlet (10) at a front side thereof and an air outlet (11) at a rear side thereof; an electric motor assembly (2) arranged in the outer casing (1), and cooperating with the outer casing (1) to define an air passage in communication with the air inlet (10) and the air outlet (11); and a silencer (3) arranged at the air inlet (10), defining at least one resonant cavity therein, and the at least one resonant cavity having a side wall provided with a throat in communication with the resonant cavity.

13 Claims, 5 Drawing Sheets

(56) References Cited

FOREIGN PATENT DOCUMENTS

| | | | |
|---|---|---|---|
| CN | 101084819 | A | 12/2007 |
| CN | 102377278 | A | 3/2012 |
| CN | 102518499 | A | 6/2012 |
| CN | 105023567 | A | 11/2015 |
| CN | 204827604 | U | 12/2015 |
| CN | 105455738 | A | 4/2016 |
| CN | 205458430 | U | 8/2016 |
| CN | 105982413 | A | 10/2016 |
| CN | 106073631 | A | 11/2016 |
| CN | 106466151 | A | 3/2017 |
| WO | WO2016105076 | A1 | 6/2016 |
| WO | WO2016/113195 | A1 | 7/2016 |
| WO | WO2019/011313 | A1 | 1/2019 |

OTHER PUBLICATIONS

Midea Group Co. Ltd., Extended European Search Report, EP18832415.6, dated Mar. 5, 2020, 7 pgs.
Midea Group Co. Ltd., Communication Pursuant to Rules 70(2) and 70a(2), EP18832415.6, dated Mar. 24, 2020, 1 pg.
International Search Report, PCT/CN2018/095569, dated Aug. 30, 2018, 4 pgs.
Midea Group Co., Ltd., WO, PCT/CN2018/095569, dated Aug. 30, 2018, 4 pgs.
Midea Group Co., Ltd., IPRP, PCT/CN2018/095569, dated Jan. 14, 2020, 5 pgs.

* cited by examiner

VACUUM CLEANER AND ELECTRIC MOTOR MODULE THEREOF

PRIORITY CLAIM AND RELATED APPLICATIONS

This application is a continuation of PCT Application No. PCT/CN2018/095569, filed Jul. 13, 2018, entitled VACUUM CLEANER AND ELECTRIC MOTOR MODULE THEREFOR, which claims priority to Chinese Patent Application No. 201710577287.8, filed Jul. 14, 2017, entitled VACUUM CLEANER AND ELECTRIC MOTOR MODULE THEREFOR, both of which are incorporated herein by reference.

FIELD

The present disclosure relates to a cleaning field, and particularly, to a vacuum cleaner and electric motor module therefor.

BACKGROUND

Vacuum cleaners produce noises, which is customers' main pain point in recent years. This problem is solved in three aspects in the industry, i.e. sources of the noises, paths transmitting the noises, and the receiver. There are two sources of the noises, which are an electric motor and a ground brush, in vacuum cleaners. Currently, the main means for reducing the noises from the sources is improvement in airflow, which includes reduction in pressure pulse (aerodynamic noise), increase in supports and dampers (structural noise), etc. However, it is difficult to make many improvements in a small space due to a small size of an electric motor body.

Regarding the paths transmitting the noises, noise-absorbing materials, such as noise-absorbing sponges, are adopted to absorb part of noises, or special structures, such as labyrinths, are adopted to weaken the energy of the noises through reflection, refraction, diffuse reflection, etc. However, the above ways of sound absorption are actually noise reduction methods with sacrifice in performance, which are not economical. Moreover, the above ways only act on high-frequency noises cannot direct at noises in different frequencies well.

In recent years, active noise cancellation, such as a noise cancellation earphone, spring up. However, the active noise cancellation is not applied much because it raises problems, such as cost, comfort during using by the users, convenience, etc.

SUMMARY

The present disclosure seeks to solve at least one of the problems existing in the related art.

To this end, the present disclosure proposes an electric motor module capable of reducing noises based on the principle of Helmholtz resonance.

The present disclosure further proposes a vacuum cleaner with the above electric motor module.

The electric motor module according to embodiments of the present disclosure includes: an outer casing provided with an air inlet at a front side of the outer casing and an air outlet at a rear side of the outer casing; an electric motor assembly arranged in the outer casing, and cooperating with the outer casing to define an air passage in communication with the air inlet and the air outlet; and a silencer arranged at the air inlet, defining at least one resonant cavity in the silencer, and the least one resonant cavity having a side wall provided with a throat in communication with the resonant cavity.

As for the electric motor module for a vacuum cleaner according to embodiments of the present disclosure, with the silencer arranged at the air inlet, the silencer includes the resonant cavity and the throat, noise reduction is achieved based on the principle of Helmholtz resonance, the noises of a targeted frequency (within which main noises are produced) can be reduced. The bottleneck in noise optimization caused by small size of an electric motor body can be passed. There is very low loss in flow, defects of large resistance in flow and sacrifice in performance caused by noise reduction methods with noise-absorbing sponges and obstructions can be overcome. Moreover, since there are small changes in a structure of the silencer, the cost is low, that means defects of a high cost and poor practical experience caused by active noise reduction method.

In some embodiments of the present disclosure, the silencer comprises an annular first silencing component, the first silencing component cooperates with the outer casing to define a first resonant cavity, one of an inner peripheral wall and an outer peripheral wall of the first silencing component is provided with a first throat in communication with the first resonant cavity.

In some embodiments of the present disclosure, the silencer further comprises a second silencing component, the second silencing component is arranged at an inner side of the first silencing component, the second silencing component defines a second resonant cavity therein, and the second silencing component is provided with a second throat in communication with the second resonant cavity.

In some embodiments of the present disclosure, the second silencing component is arranged on the inner peripheral wall of the first silencing component by means of a connecting assembly.

In some embodiments of the present disclosure, the connecting assembly is formed in an annular structure, an inner peripheral wall and an outer peripheral wall of the connecting assembly are connected to the first silencing component and the second silencing component respectively by means of a plurality of connecting sheets spaced apart from each other.

In some embodiments of the present disclosure, the second silencing component comprises a front end face, a rear end face, and an annular side plate, a front end and a rear end of the side plate are connected to the front end face and the rear end face respectively to define the second resonant cavity, and the side plate is provided with the second throat.

In some embodiments of the present disclosure, the outer peripheral wall of the first silencing component is in contact with an inner wall of the air inlet, and the first throat is arranged on the inner peripheral wall of the first silencing component.

Furthermore, a longitudinal section of the inner peripheral wall of the first silencing component is a bevel obliquely extending inwards and backwards.

In some embodiments of the present disclosure, the air passage comprises a noise reduction passage in the electric motor assembly.

Furthermore, a part of the air passage located between the air inlet and an inlet of the noise reduction passage has a gradually reduced passage area, in a direction from the air inlet to the air outlet.

Preferably, a noise-absorbing material is arranged in the resonant cavity.

Preferably, a plurality of resonant cavities are provided and configured to eliminate noises of different frequencies.

The vacuum cleaner according to embodiments of the present disclosure includes the electric motor module according to the above embodiments of the present disclosure.

The vacuum cleaner according to embodiments of the present disclosure is provided with the aforementioned electric motor module, noise reduction is achieved based on the principle of Helmholtz resonance, the noises of a targeted frequency (within which main noises are produced) can be reduced. The bottleneck in noise optimization caused by small size of an electric motor body can be passed. There is very low loss in flow, defects of large resistance in flow and sacrifice in performance caused by noise reduction methods with noise-absorbing sponges and obstructions can be overcome. Moreover, since there are small changes in a structure of the silencer, the cost is low, that means defects of a high cost and poor practical experience caused by active noise reduction method.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and/or advantages of embodiments of the present disclosure will become apparent and more readily appreciated from the following descriptions made with reference to the drawings, in which.

Figure 1:
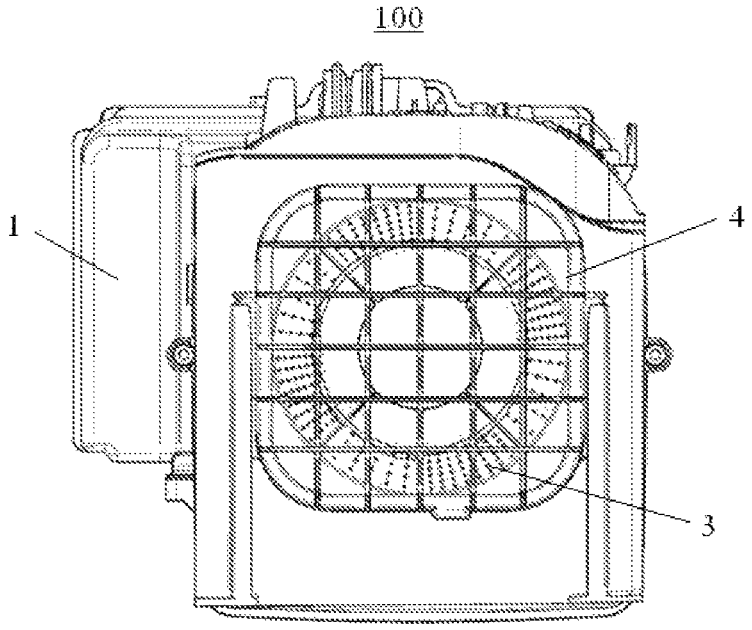
FIG. 1 is a front view of an electric motor module according to embodiments of the present disclosure.
Figure 2:
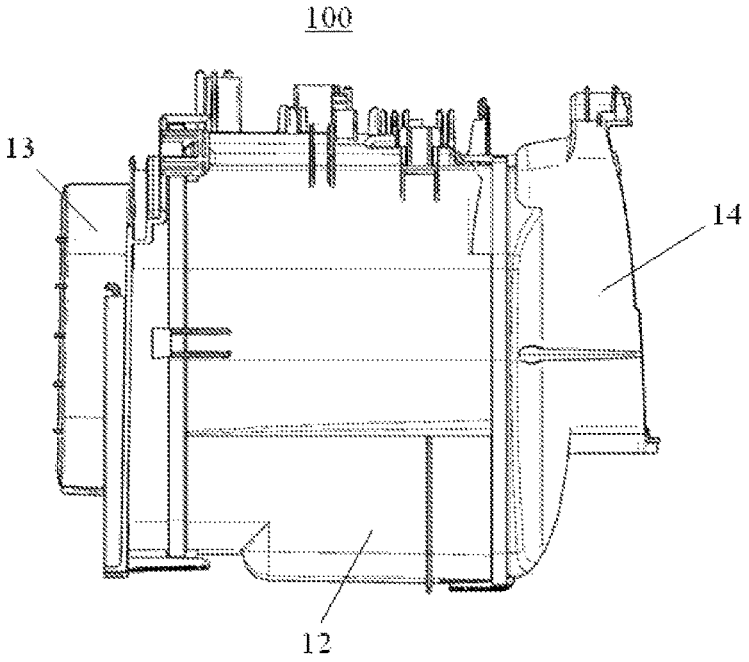
FIG. 2 is a side view of an electric motor module according to embodiments of the present disclosure.
Figure 3:
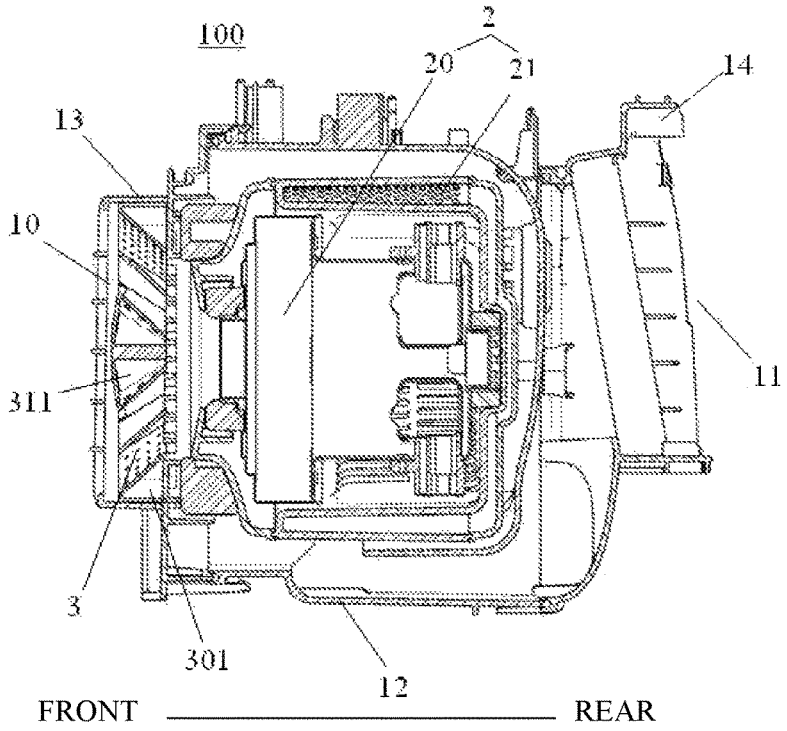
FIG. 3 is a sectional view of an electric motor module according to embodiments of the present disclosure.
Figure 4:
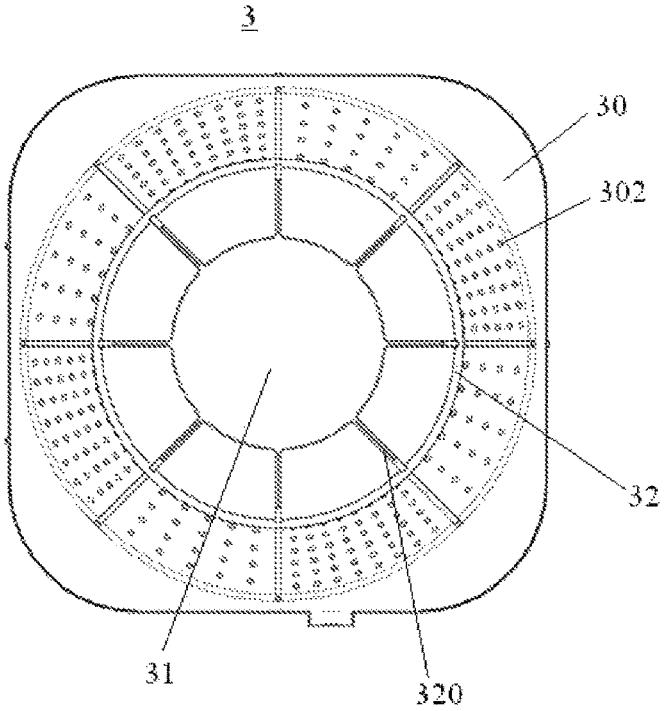
FIG. 4 is a front view of a silencer according to embodiments of the present disclosure.

Reference Numerals:

electric motor module 100;

outer casing 1; air inlet 10; air outlet 11; housing 12; front cover 13; rear cover 14;

electric motor assembly 2; electric motor 20; electric motor housing 21;

silencer 3; first silencing component 30; first resonant cavity 301; first throat 302; second silencing component 31; second resonant cavity 311; second throat 312; front end face 313; rear end face 314; side plate 315; reinforcing column 316; connecting assembly 32; connecting sheet 320;

air-inlet grille 4.

DETAILED DESCRIPTION

Embodiments of the present disclosure are described in detail, and examples of the embodiments are depicted in the drawings. The same or similar elements and the elements having same or similar functions are denoted by like reference numerals throughout the descriptions. The embodiments described herein with reference to drawings are explanatory and only used to illustrate the present disclosure. The embodiments shall not be construed to limit the present disclosure.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "axial," "radial," and "circumferential" should be construed to refer to the orientation as then described or as shown in the drawings under discussion. These relative terms are for convenience of description and do not require that the present invention be constructed or operated in a particular orientation, which shall not be construed to limit the present disclosure. In addition, terms such as "first" and "second" are used herein for purposes of description and are not intended to indicate or imply relative importance or significance or to imply the number of indicated technical features. Thus, the feature defined with "first" and "second" may indicate or imply that one or more of this feature is included. In the description of the present invention, the term "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

An electric motor module 100 for a vacuum cleaner according to embodiments of the present disclosure is described referring to FIG. 1 to FIG. 9. The vacuum cleaner generally includes a dust collecting component and a filtering component. The electric motor module 100 refers to a module air passage assembly from a downstream of the dust collecting component to an upstream of the filtering component. Specifically, the dust collecting component can be a dust bag or a dust cup, and the filtering component can be a high efficiency particle air (HEAP) filter screen.

As shown in FIG. 1, the electric motor module 100 according to embodiments of the present disclosure includes an outer casing 1, an electric motor assembly 2, and a silencer 3. The outer casing 1 is provided with an air inlet 10, the outer casing 1 at a front side and an air outlet 11 at the rear side. Specifically, the outer casing 1 includes a front cover 13, a housing 12, and a rear cover 14. The housing 12 has an open front end and an open rear end. The front cover 13 is arranged at the front end of the housing 12 and provided with the air inlet 10, and the rear cover 14 is arranged at the rear end of the housing 12 and provided with the air outlet 11. Furthermore, the air inlet 10 can be provided with an air-inlet grille 4 in front of the silencer 3.

The electric motor assembly 2 is located in the outer casing 1, and the electric motor assembly 2 cooperates with the outer casing 1 define an air passage in communication with the air inlet 10 and the air outlet 11. It should be noted that the electric motor assembly 2 includes the electric motor housing 21 and the electric motor 20, the electric motor 20 is arranged in the electric motor housing 21, the electric motor 20 is connected to an impeller to drive the impeller to rotate, such that the external air is introduced into the air passage through the air inlet 10, and the air in the air passage is guided to the air outlet 11.

The silencer 3 is arranged at the air inlet 10 and defines at least one resonant cavity. The resonant cavity has a side wall provided with a throat in communication with the resonant cavity. The resonant cavity can be in the shape of a rectangle, a ball, or an irregular structure meeting a structural requirement of a whole device, etc.

Specifically, when air flows through the air inlet 10, a part of air can enter the resonant cavity through the throat, noise cancellation works based on the three aspects as follows. (1) Gas in the throat resists speed fluctuations caused by sound waves like a piston. (2) The throat forms a hole-neck structure, which rubs and damps the gas to consume sound energy. (3) The resonant cavity can impede pressure fluctuations, similar to a spring, and since the resonant cavity is closed, there is minimum loss in energy of airflow. From this, it can easily be seen that s sound pressure level of a target frequency can be obviously weakened with the noise absorbing device which using the resonant cavity as a Helmholtz resonant-noise-cancellation cavity.

During design, after a volume of the resonant cavity is determined, on the premise of consistent length and sectional area of the throat, the noise which is reduced has a consistent frequency. The more holes (the smaller a diameter of the throat), the better noise reduction at the frequency is achieved. It is proposed that one or more holes are defined, and in case of more holes, the more holes are evenly distributed in a direction perpendicular to the air passage.

According to actual needs, a diameter d of section of a single throat of the resonant cavity (or the diameter of a single throat equivalent to a plurality of throats) and a width L of a passage (the air passage at the air inlet 10) satisfy that L is less than or equal to 3 d, a plurality of throats connected in parallel are needed in case of beyond the range until a specified range is satisfied. A middle line of the throat is kept perpendicular to a middle line of the passage (the air passage at the air inlet 10). When a plus or minus deviation exceeds 20°, a formula about the frequency of noise to be cancelled needs amending to generally meet a requirement for angles. A diameter ds in a height direction of the passage should be smaller than or equal to 5 d (the diameter of a single throat or the diameter of a single throat equivalent to a plurality of throats).

As for the electric motor module 100 for a vacuum cleaner according to embodiments of the present disclosure, with the silencer 3 arranged at the air inlet 10, the silencer 3 includes the resonant cavity and the throat, noise reduction is achieved based on the principle of Helmholtz resonance, the noises of a targeted frequency (within which main noises are produced) can be reduced. The bottleneck in noise optimization caused by small size of an electric motor 20 body can be passed. There is very low loss in flow, defects of large resistance in flow and sacrifice in performance caused by noise reduction methods with noise-absorbing sponges and obstructions can be overcome. Moreover, since there are small changes in a structure of the silencer 3, the cost is low, that means defects of a high cost and poor practical experience caused by active noise reduction method.

As shown in FIG. 1, FIG. 3 to FIG. 9, in some embodiments of the present disclosure, the silencer 3 includes an annular first silencing component 30, the first silencing component 30 cooperates with the outer casing 1 to define a first resonant cavity 301, one of an inner peripheral wall and an outer peripheral wall of the first silencing component 30 is provided with a first throat 302 in communication with the first resonant cavity 301. Specifically, air flows through an inner side of the first silencing component 30, and the first throat 302 cooperates with the first resonant cavity 301 to reduce noises based on the principle of Helmholtz resonance. It should be noted that when the first throat 302 is located at the outer peripheral wall of the first silencing component 30, an air passage should be defined between the outer peripheral wall of the first silencing component 30 and an inner peripheral wall of the air inlet 10. Specifically, a plurality of first throats 302 are provided and distributed in a circumferential direction at intervals. It should be noted that the first resonant cavity 301 can be arranged in the first silencing component 30, or the first resonant cavity 301 can be defined by the first silencing component 30 and the outer casing 1. In a specific embodiment of the present disclosure, by setting sizes of the first resonant cavity 301 and the first throat 302, the first silencing component 30 can eliminate noises of two different frequencies, such as 1250 Hz and 4240 Hz.

Furthermore, a noise-absorbing material, such as a noise-absorbing sponge, etc., is filled in the first resonant cavity 301, and a design formula for the resonant cavity can be amended according to a coefficient of sound absorption of a noise-absorbing sponge.

In example shown in FIG. 1, and from FIG. 3 to FIG. 9, the outer peripheral wall of the first silencing component 30 is in contact with the inner wall of the air inlet 10, and the first throat 302 is arranged on the inner peripheral wall of the first silencing component 30, such that the first silencing component 30 can be conveniently mounted. In some specific examples of the present disclosure, the inner peripheral wall the first silencing component 30 is provided with a plurality of first hole groups and a plurality of second hole groups, each first hole group includes a plurality of first throats 302, and each second hole group includes a plurality of first throats 302, the plurality of first hole groups and the plurality of second hole groups are offset with respect to each other in a circumferential direction. The distribution of the first throats 302 of the first hole group is different from the distribution of the first throats 302 of the second hole group, for example a density of the distribution of the first throats 302 of the first hole group is greater than a density of the distribution of the first throats 302 of the second hole group, such that the first silencing component 30 can eliminate noises of different frequencies.

Figure 8:
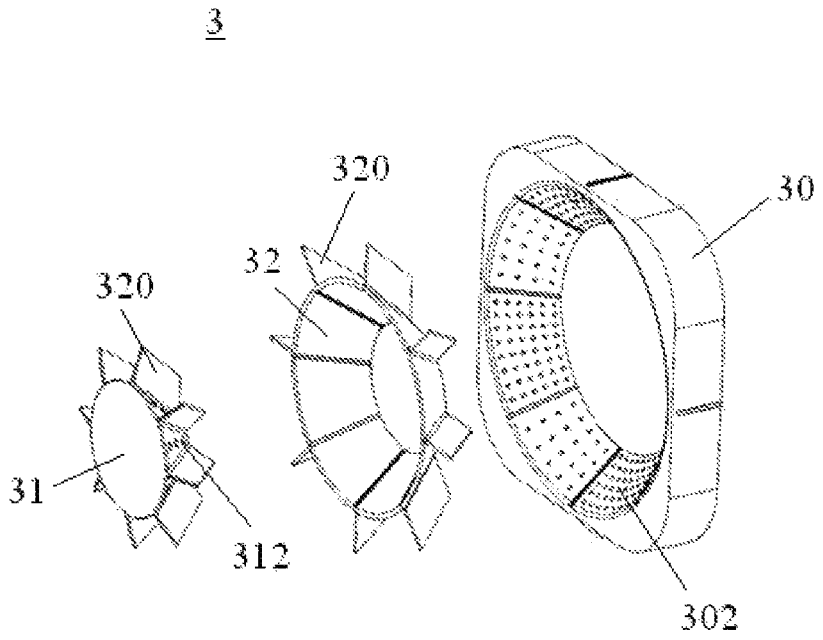
FIG. 8 is an exploded view of a silencer according to embodiments of the present disclosure.
Figure 9:
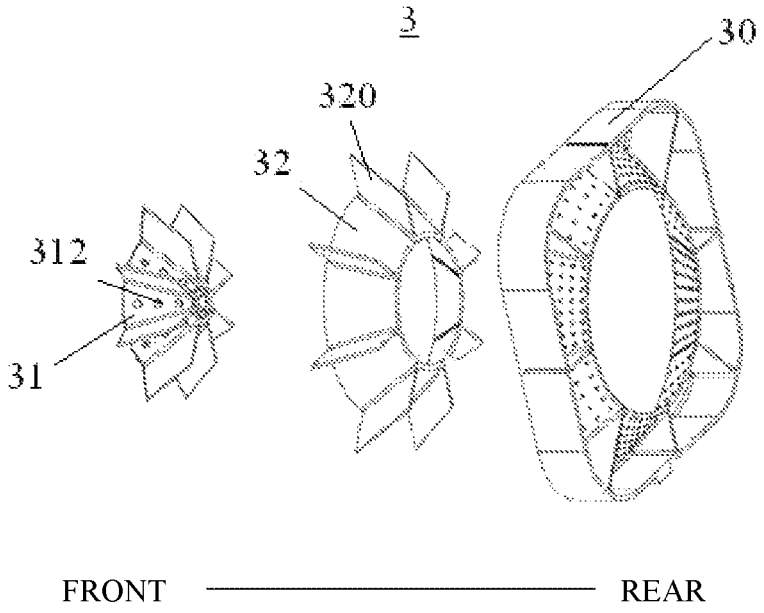
FIG. 9 is an exploded view of a silencer according to embodiments of the present disclosure front another direction.

As shown in FIG. 8 and FIG. 9, in some embodiments of the present disclosure, a longitudinal section of the inner peripheral wall of the first silencing component 30 is a bevel obliquely extending inwards and backwards, such that air at the air inlet 10 can be guided, it can be guaranteed that air at the air inlet 10 smoothly flows with low loses in airflow.

In a further embodiment of the present disclosure, as shown in FIG. 1, and from FIG. 3 to FIG. 9, the silencer 3 further includes a second silencing component 31, the second silencing component 31 is arranged at an inner side of the first silencing component 30, the second silencing component 31 defines a second resonant cavity 302 therein, and the second silencing component 31 is provided with a second throat 312 in communication with the second resonant cavity 302. Specifically, the second silencing component 31 and the first silencing component 30 defines an air passage therebetween, air flows along an outer peripheral wall of the second silencing component 31, the second throat 312 cooperates with the second resonant cavity 302 to reduce noises based on the principle of Helmholtz resonance. With the second silencing component 31, noise cancellation can be further improved. In a specific embodiment of the present disclosure, by setting sizes of the second resonant cavity 302 and the second throat 312, the second silencing component 31 can eliminate noises of 4240 Hz. Furthermore, a noise-absorbing material, such as a noise-absorbing sponge, etc., is filled in the second resonant cavity 302, and a design formula for the resonant cavity can be amended according to a coefficient of sound absorption of a noise-absorbing sponge.

Specifically, the second silencing component 31 is arranged on the inner peripheral wall of the first silencing component 30 via a connecting assembly 32, such that the second silencing component 31 can be conveniently mounted. In order to reduce resistance to airflows caused by the connecting assembly 32, in some embodiments of the present disclosure, the connecting assembly 32 is in an annular structure, an inner peripheral wall and an outer peripheral wall of the connecting assembly 32 are connected to the first silencing component 30 and the second silencing component 31 respectively by means of a plurality of connecting sheets 320 spaced apart from each other. That means, the inner peripheral wall of the connecting assembly 32 is connected to the second silencing component 31 by means of a plurality of connecting sheets 320, and the outer peripheral wall of the connecting assembly 32 are connected to the first silencing component 30 by means of a plurality of connecting sheets 320. In the example shown in FIG. 8 and FIG. 9, the connecting assembly 32 and the plurality of connecting sheets 320 provided on the outer peripheral wall are an integrally formed piece. Optionally, the plurality of connecting sheets 320 at the same side wall of the connecting assembly 32 are evenly distributed at an interval in a circumferential direction.

Figure 5:
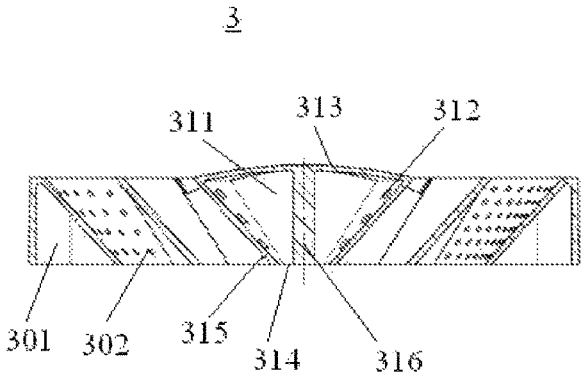
FIG. 5 is a sectional view of a silencer according to embodiments of the present disclosure.
Figure 6:
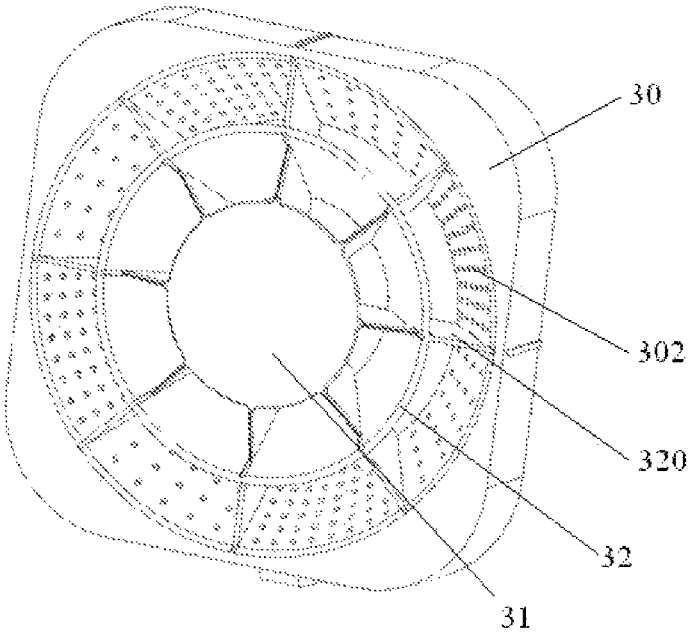
FIG. 6 is a perspective view of a silencer according to embodiments of the present disclosure.
Figure 7:
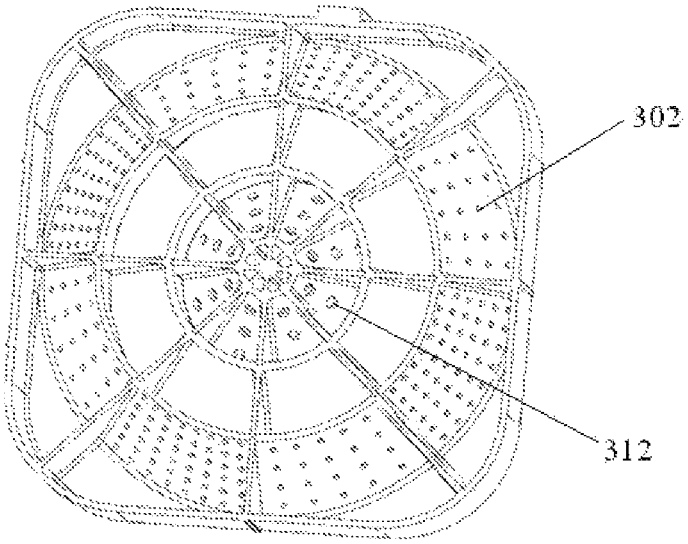
FIG. 7 is a partially sectional view of a silencer according to embodiments of the present disclosure.

In a specific embodiment of the present disclosure, as shown in FIG. 4 to FIG. 9, the second silencing component 31 includes a front end face 313, a rear end face 314 and an annular side plate 315. A front end and a rear end of the side plate 315 are connected to the front end face 313 and the rear end face 314 respectively to define the second resonant cavity 302. The side plate 315 is provided with the second throat 312, such that the second silencing component 31 is simple in structure. Certainly, it should be noted that a structure of the second silencing component 31 is not limited thereto. For example, the second silencing component 31 can be in an annular structure. In order to enhance a structural strength of the second silencing component 31, as shown in FIG. 5, the second resonant cavity 302 is provided a reinforcing column 316 therein, and a front end and a rear end of the reinforcing column 316 are connected to the front end face 313 and the rear end face 314 respectively.

As shown from FIG. 3 to FIG. 9, the side plate 315 has a cross sectional area gradually reducing in a direction from the front to the rear, such that the second resonant cavity 311 has a cross sectional area of gradually reducing in a direction from the front to the rear. The side plate 315 of the second silencing component 31 forms a guide face guiding inwards, such that it is guaranteed that air flows smoothly at the air inlet 10, and loss in airflow is lowered.

In an optimal embodiment of the present disclosure, a plurality of resonant cavities are provided, and the plurality of resonant cavities are configured to cancel noises of different frequencies, such that noise reduction of the electric motor module 100 can be improved. It should be noted that when the silencer 3 includes the first silencing component 30 and the second silencing component 31, the first silencing component 30 and the second silencing component 31 can eliminated noises of different frequencies.

In some embodiments of the present disclosure, the air passage includes a noise reduction passage arranged in the electric motor assembly 2, such that noise reduction of the electric motor module 100 can be improved. Furthermore, a part of the air passage located between the air inlet 10 and an inlet of the noise reduction passage has a gradually reduced passage area with even transition and without sudden changes, in a direction from the air inlet 10 to the air outlet 11, such that the loss in airflow can be reduced. For example, the passage area reduces in a linear rule.

In a specific embodiment of the present disclosure, the electric motor housing 21 is in a multi-layer structure, the outer peripheral wall of the electric motor housing 21 and the outer casing 1 define a flowing space therebetween in communication with the air outlet 11, an outermost layer of the electric motor housing 21 is provided with an outlet in communication with the flowing space, adjacent two layers of the electric motor housing 21 define a noise reduction passage therebetween, and an innermost layer of the electric motor housing 21 is provided with an inlet, such that the electric motor housing 21 defines a labyrinth noise reduction passage therein to further reduce noises. Air entering through the air inlet 10 passes through the electric motor 20, enters the labyrinth noise reduction passage in the electric motor housing 21 through the inlet, flows to the flowing space through the outlet, and finally exits through the air outlet 11.

A silencer 3 according to a specific embodiment according to the present disclosure is described in detail referring to FIG. 1 to FIG. 9.

According to embodiments of the present disclosure, the silencer 3 includes the first silencing component 30, the second silencing component 31, and the connecting assembly 32. The first silencing component 30 is in an annular structure, the outer peripheral wall of the first silencing component 30 is formed in the shaped of a rectangle and attached to the inner wall of the air inlet 10, the inner peripheral wall of the first silencing component 30 has a circular section, and a longitudinal section of the inner peripheral wall of the first silencing component 30 is a bevel obliquely extending inwards and backwards. The inner peripheral wall of the first silencing component 30 is provided with a plurality of first throats 302, a rear side of the first silencing component 30 is opened, and the first silencing component 30 is provided on the outer casing 1. The inner peripheral wall and the outer peripheral wall of the first silencing component 30, and the outer casing 1 together define the first resonant cavity 301.

The second silencing component 31 includes the front end face 313, the rear end face 314, and the annular side plate 315. The front end and the rear end of the side plate 315 are connected to the front end face 313 and the rear end face 314 respectively to define the second resonant cavity 302. The side plate 315 is provided with the second throat 312, and a cross sectional area of the side plate 315 gradually reduces in a direction from the front to the rear. The side plate 315 is provided with a plurality of connecting sheets 320 spaced apart from each other at an outer peripheral surface.

The connecting assembly 32 is formed in an annular structure, the outer peripheral wall of the connecting assembly 32 is provided with a plurality of the connecting sheets 320 spaced apart from each other, and a cross sectional area of the connecting assembly 32 gradually reduces in a direction from the front to the rear.

The first silencing component 30 can be fitted over the connecting assembly 32 by means of the plurality of connecting sheets 320 or an interference fit is provided between the first silencing component 30 and the connecting assembly 32 by means of the plurality of connecting sheets 320, such that a detachable connection is achieved. The connecting assembly 32 can be fitted over the second silencing component 31 by means of the plurality of connecting sheets 320 or an interference fit is provided between the second silencing component 31 and the connecting assembly 32 by means of the plurality of connecting sheets 320, such that a detachable connection is achieved. It should be noted that the first silencing component 30, the second silencing component 31, the connecting assembly 32, and the plurality of connecting sheets 320 can also be an integrally formed piece.

The first silencing component 30 and the connecting assembly 32 define an inner-layer air introduction passage therebetween, and the second silencing component 31 and the connecting assembly 32 defines an outer-layer air introduction passage therebetween.

With the silencer 3 according to embodiments of the present disclosure, assembling and the follow-up dust cleaning are convenient. At the meantime, the passage is bent owing to a design with three sections, therefore the noises produced at the electric motor assembly 2 undergo noise elimination by refraction, reflection, diffuse reflection, etc., which facilitates noise reduction.

A vacuum clear according to embodiments of the present disclosure includes the electric motor module 100 according to the above embodiments.

The vacuum cleaner according to embodiments of the present disclosure is provided with the aforementioned electric motor module 100, noise reduction is achieved based on the principle of Helmholtz resonance, the noises of a targeted frequency (within which main noises are produced) can be reduced. The bottleneck in noise optimization caused by small size of an electric motor 20 body can be passed. There is very low loss in flow, defects of large resistance in flow and sacrifice in performance caused by noise reduction methods with noise-absorbing sponges and obstructions can be overcome. Moreover, since there are small changes in a structure of the silencer 3, the cost is low, that means defects of a high cost and poor practical experience caused by active noise reduction method.

Other configurations, such as a cleaning component, a running component, etc., and operations for the vacuum cleaner according to embodiments of the present disclosure are knows to the skilled person in the art, which will not be described in detail herein.

Throughout the description of the present disclosure, reference to "an embodiment," "some embodiments," "explanatory embodiment", "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An electric motor module for a vacuum cleaner, comprising:

an outer casing provided with an air inlet at a front side of the outer casing and an air outlet at a rear side of the outer casing;

an electric motor assembly arranged in the outer casing, and cooperating with the outer casing to define an air passage in communication with the air inlet and the air outlet; and a silencer arranged at the air inlet, defining at least one resonant cavity in the silencer, and the least one resonant cavity having a side wall provided with a throat in communication with the resonant cavity.

2. The electric motor module according to claim 1, wherein the silencer comprises an annular first silencing component, the first silencing component cooperates with the outer casing to define a first resonant cavity, one of an inner peripheral wall and an outer peripheral wall of the first silencing component is provided with a first throat in communication with the first resonant cavity.

3. The electric motor module according to claim 2, wherein the silencer further comprises a second silencing component, the second silencing component is arranged at an inner side of the first silencing component, the second silencing component defines a second resonant cavity therein, and the second silencing component is provided with a second throat in communication with the second resonant cavity.

4. The electric motor module according to claim 3, wherein the second silencing component is arranged on the inner peripheral wall of the first silencing component by means of a connecting assembly.

5. The electric motor module according to claim 4, wherein the connecting assembly is formed in an annular structure, an inner peripheral wall and an outer peripheral wall of the connecting assembly are connected to the first silencing component and the second silencing component respectively by means of a plurality of connecting sheets spaced apart from each other.

6. The electric motor module according to claim 3, wherein the second silencing component comprises a front end face, a rear end face, and an annular side plate, a front end and a rear end of the side plate are connected to the front end face and the rear end face respectively to define the second resonant cavity, and the side plate is provided with the second throat.

7. The electric motor module according to claim 2, wherein the outer peripheral wall of the first silencing component is in contact with an inner wall of the air inlet, and the first throat is arranged on the inner peripheral wall of the first silencing component.

8. The electric motor module according to claim 7, wherein a longitudinal section of the inner peripheral wall of the first silencing component is a bevel obliquely extending inwards and backwards.

9. The electric motor module according to claim 1, wherein the air passage comprises a noise reduction passage in the electric motor assembly.

10. The electric motor module according to claim 9, wherein a part of the air passage located between the air inlet and an inlet of the noise reduction passage has a gradually reduced passage area, in a direction from the air inlet to the air outlet.

11. The electric motor module according to claim 1, wherein a noise-absorbing material is arranged in the resonant cavity.

12. The electric motor module according to claim 1, wherein a plurality of resonant cavities are provided and configured to eliminate noises of different frequencies.

13. A vacuum cleaner, comprising the electric motor module according to claim 1.

* * * * *